US005363508A

United States Patent [19]

Kim

[11] Patent Number: 5,363,508

[45] Date of Patent: Nov. 15, 1994

[54] FINGER AND PALM GUARD

[76] Inventor: Ok C. Kim, 3024 Sandstone Apt. #11, Manhattan, Kans. 66502

[21] Appl. No.: 92,885

[22] Filed: Jul. 19, 1993

[51] Int. Cl.[5] ..... A41D 13/08

[52] U.S. Cl. ..... 2/21

[58] Field of Search ..... 294/25; 2/21, 16, 20, 2/159, 161.6, 161.8, 161.6, 163; 223/101; 30/233; 132/213, 213.1, 214

[56] References Cited

U.S. PATENT DOCUMENTS

| | | | |
|---|---|---|---|
| 1,074,864 | 10/1913 | Howell . | |
| 2,045,157 | 6/1936 | Mathias | 2/16 |
| 2,725,570 | 12/1955 | Penna . | |
| 3,348,541 | 10/1967 | Loebeck . | |
| 3,728,736 | 4/1973 | Pugh . | |
| 3,928,871 | 12/1975 | Wall | 2/161.8 |
| 3,975,043 | 8/1976 | Miles | 294/25 |
| 4,689,828 | 9/1987 | Brewer | 2/21 |
| 4,796,302 | 1/1989 | Davis et al. | 2/21 |
| 4,908,881 | 3/1990 | Field . | |
| 5,048,186 | 9/1991 | Lamb et al. . | |

FOREIGN PATENT DOCUMENTS

| | | | |
|---|---|---|---|
| 0220452 | 12/1986 | European Pat. Off. . | |
| 2645718 | 10/1990 | France | 2/16 |
| 455760 | 2/1928 | Germany . | |
| 963141 | 5/1957 | Germany . | |
| 19082 | of 1894 | United Kingdom | 294/25 |
| 2183990 | 6/1987 | United Kingdom | 2/21 |

*Primary Examiner*—Clifford D. Crowder
*Assistant Examiner*—Paul C. Lewis
*Attorney, Agent, or Firm*—Richard C. Litman

[57] ABSTRACT

A finger and palm guard for barbers and cosmetologists may be made up of a pair of tubular members or rings that accommodate the middle and index fingers of the user's hand. Attached to and extending from each of these members is a projection that extends over the palmar fascia in the region immediately adjacent the knuckles joining the metacarpals and the third phalanges of both the middle and index fingers. Both projections lie in substantially the same plane and are connected to one another by a rivet or similar pivotable connection that will allow natural movement of the fingers toward and away from one another when the device is being employed.

12 Claims, 2 Drawing Sheets

FINGER AND PALM GUARD

BACKGROUND OF THE INVENTION

1. Field of the Invention

The present invention relates to protective devices. More specifically, it relates to hand and fingers protectors. Even more specifically, it relates to a fingers and hand protector for barbers and/or cosmetologists that is made up of two cylindrical members configured to fit over a user's middle and index fingers. Both the members have protruding shield areas that extend, when the device is fitted and worn on the hand, over the adjacent palm area, or palmar fascia, adjacent the third knuckle of the index and middle fingers, and flexure area between the two fingers. The two shield members are pivotally connected together by a rivet type arrangement or the like to allow the fingers to be moved apart from one another when the user desires.

2. Description of the Prior Art

Modern hair cutting technique posits that the barber or cosmetologist, when trimming or cutting hair, grasp an amount of it between their middle and index fingers and then cut the hair along the fingers, using the fingers as a guide. With the sharp scissors that are used in this environment along with the speed that the professional needs to use to enhance profitability, accidents can: and do occur. Cutting a finger or poking the tip of the scissors into the palm of the hand not only forces the barber to stop working to staunch the bleeding, but additionally is embarrassing, is painful, not only from the infliction and resultant pain from the wound, but also from small pieces of hair that work their way into the wound, and is unhygienic, for the reasons listed above. The vector for the transmission of various diseases is present in both directions by the spilled blood and the hair that could conceivably become lodged in the wound. The present invention addresses this problem by presenting a finger and palm guard that substantially covers the areas at risk during the cutting process.

The following is a discussion of relevant prior art patents uncovered during a search.

The most relevant patent is U.S. Pat. No. 5,048,186 issued on Sep. 17, 1991 to George L. Lamb et al. This patent discloses a shear guard made of a band of planar material that is disposed such that the wider end of the device covers the knuckle of the finger. However, the Lamb et al guard protects only the third phalange of the middle finger and provides no protection whatever for the palmar fascia area in the region immediately adjacent the knuckles joining the metacarpals and the third phalanges of both the middle and index fingers, and does not protect the index finger at all.

In U.S. Pat. No. 4,908,881 issued on Mar. 20, 1990 to Frank P. Field, there is disclosed a finger guard. This is a sheath-like device that fits over the end of an injured human finger or toe and is remote from the area of barbering and cosmetology.

Next is U.S. Pat. No. 3,728,736 issued on Apr. 24, 1973 to Evelyn M. Pugh. This discloses a thumb or finger guard having a forward closed portion that fits over the thumb and its nail and extends back to the first knuckle. The device protects a thumb or finger while paring, cutting, tearing or grating vegetables such as apples, potatoes, carrots, etc., with a paring knife held in the other hand. The guard includes ridges to facilitate a secure grip on the vegetable and provide a guard area with a thickened portion more resistant to penetration by a knife. This finger or thumb guard would provide no protection at all for the palm and fingers of a barber or cosmetologist while engaged in their profession.

The remainder of the patents discussed below are more remote from the instant invention. U.S. Pat. No. 1,074,884 issued Oct. 7, 1913 to Thomas H. Howell shows a twine cutter interengaged with the ring and little fingers of the hand; no protection feature is present. U.S. Pat. No. 2,725,570 issued Dec. 6, 1955 to Ernest Penna illustrates a ladies' glove covering the entire hand and wrist and allowing exposure of the nails, for aesthetic purposes. Another fingertip bandage is seen in U.S. Pat. No. 3,348,541, issued Oct. 24, 1967. Another fingertip worn device to protect the finger during counting of money bills, for example, is shown in German Patent No. 455,760, issued Jan. 19, 1928 to Albert Heusser. A multiple finger cover that does not interfere with tactile feedback but otherwise provides none of the protective advantages of the instant invention is disclosed in German Patent No. 963,141 issued May 2, 1957.

In addition, European Patent Application No. 0220452, published on Jun. 5, 1987 for Shozo Iriyama simply discloses another fingertip protector, but adapted for use with a work glove.

None of the above inventions and patents, taken either singly or in combination, is seen to describe the instant invention as claimed.

SUMMARY OF THE INVENTION

The present invention is a finger and palm guard for barbers and cosmetologists. It consists of a pair of tubular members that accommodate the middle and index finger of the user's hand. Attached to and extending from each of these members is a projection that extends over the ball of the finger: i.e. the palmar fascia in the region immediately adjacent the knuckles joining the metacarpals and the third phalanges of both the middle and index fingers. Both projections lie in substantially the same plane and are connected to one another by a rivet or similar pivotable connection that will allow natural movement of the fingers toward and away from one another when the device is being employed.

Accordingly, it is a principal object of the invention to provide a finger and palm guard that substantially covers the area at risk from puncture or slicing wounds when using scissors to cut hair in the established manner wherein a portion of hair is grasped between the index and middle finger and the fingers are used as a guide for the scissors.

It is another object of the invention to provide a finger and palm guard that is easily put on and removed in a barber shop or salon environment and that does not sacrifice tactile feedback.

It is a further object of the invention to provide a finger and palm guard wherein the extensions that cover the palm portion of the hand adjacent the index and middle finger are movably attached to one another such that the fingers in question can be moved in a natural manner toward and away from one another to facilitate the grasping of hair between them.

Still another object of the invention is to provide a finger and palm guard wherein the extensions that cover the palm portion of the hand adjacent the index and middle finger are sufficiently flexible to allow for natural movement of the fingers in question relative to the plane generally described by the palm of the hand at rest.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
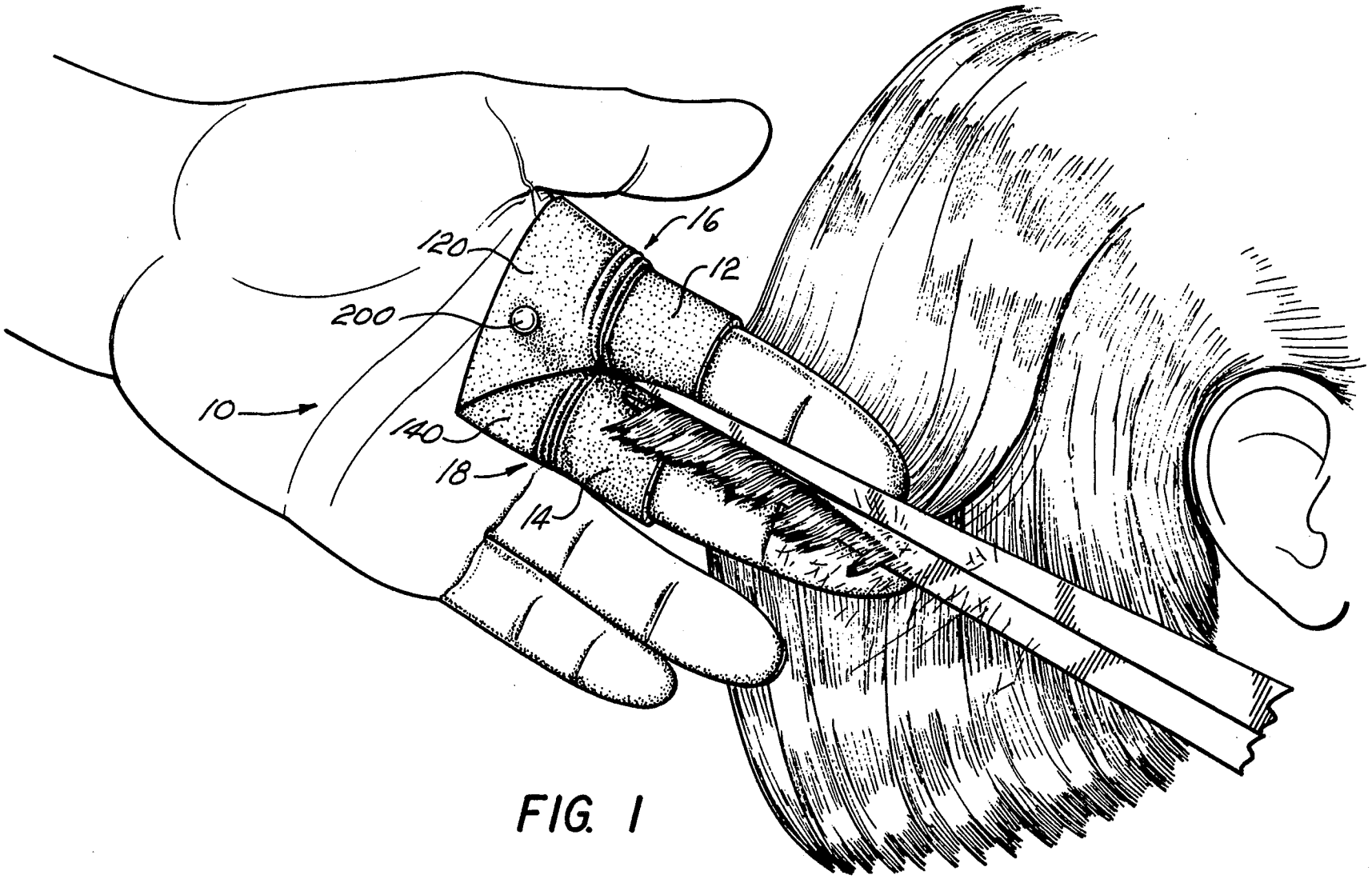
FIG. 1 is a full scale perspective view showing the use of the invention during hair cutting.

The present invention is indicated generally in the several drawing figures at 10. There are two cylindrical members 12 and 14 that are designed to fit over the third phalange of the index finger, which is also known as the forefinger or second finger, and middle finger, which is also known as the third finger of the hand. It should be understood that the device would perforce be made in a variety of sizes to account for the differences in hand sizes among people. Both cylindrical members will have approximately the same diameter.

Extending from each of the cylindrical members 12, 14 are palm shields 120, 140. These shields extend over the palm area or palmar fascia immediately adjacent the knuckles joining the metacarpals and the third phalanges of both the middle and index fingers and also help protect the flexure area between the palmar fascia and third phalanges. The shields could be integral with the cylindrical members, or could be sonically welded thereto. In this preferred embodiment, these shields 120, 140 are connected to each other by a pivoting element such as rivet 200, that functions as a pivotal, movable engagement means to, allow the two shields and thus the user's fingers to move toward and away from one another rather easily. Other types of movable interengagement means could be used, of course. The device can be of unitary construction and the engagement allowing for the movement of the fingers away from one another could be a living hinge, for example.

Another feature of the invention are the flexible areas 16, 18 on each of the cylindrical members. The flexible members 16, 18 are located between the cylindrical members 12, 14 and the palm or palmar fascia shields 120, 140. This allows for the movement of the fingers as would be necessary if the user wished to grip an object without removing the device.

A wide variety of materials could be used in manufacturing the device, depending on whether it was desired to have the device be reusable or disposable. Various types of plastics, metal, leather, or combinations thereof are contemplated. The rivet 200 is of the commonly available type that allows two parallel planar surfaces to relatively freely rotate in relation to one another. The rivet made be a snap or pop rivet, with the two halves readily separable from one another, or a permanent rivet. Depending on the materials used to construct the device, these flexible areas could be made of a thinner plastic, for example, if an injection or blow molded plastic manufacturing process was used for the construction of the device. In any event, the material used would have to be of sufficient strength to prevent a sharp edge or point of a pair of scissors from penetrating the device in this area and possibly causing a wound injury to the user.

Figure 3:
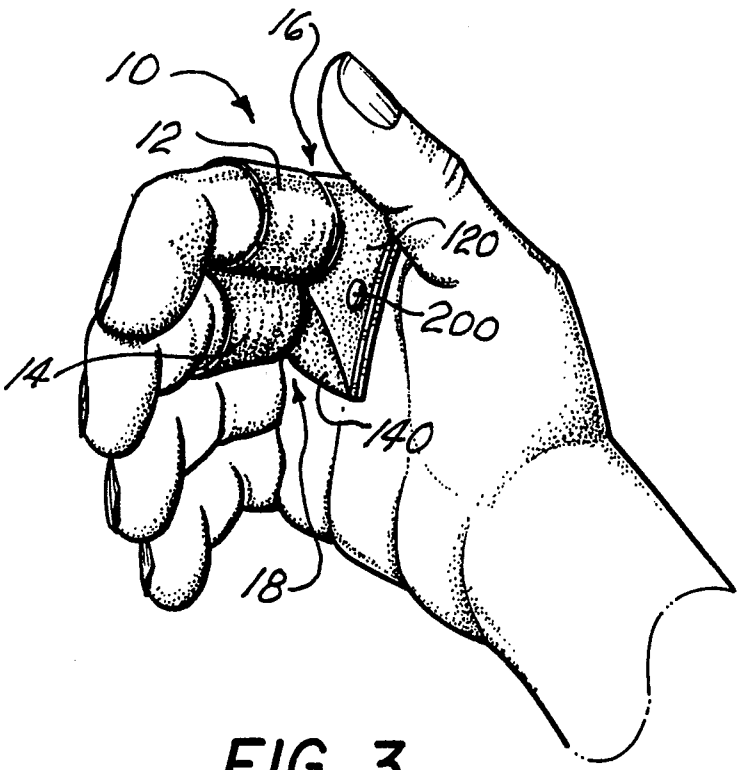
FIG. 3 is a perspective view of the invention fitted over user's right hand and fingers (thus, for use by a left handed individual), and showing flexing of the guard to substantially maximum extent, with the fingers of the hand moved toward the palm of the individual.
Figure 2:
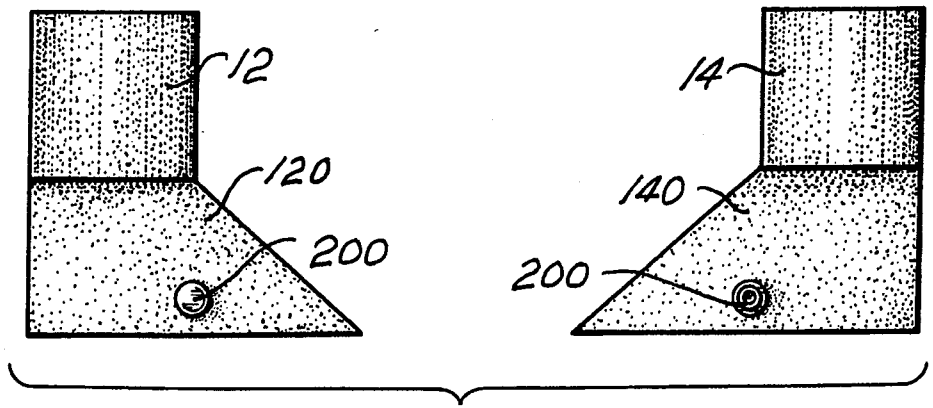
FIG. 2 is a reduced scale, exploded front elevational view of the invention, showing the two constituent halves of the invention.

Referring now to FIG. 3 more specifically, it can be readily appreciated that the invention can be worn on either hand of the user, assuming the diameter of the two cylindrical portions of the guard are pretty much the same, Thus, a single type of universal guard can be fabricated, of only a single or a few sizes, that can be fitted on either hand of the user, and thus be readily usable by either a right handed or left handed barber or cosmetologist.

It is to be understood that the present invention is not limited to the embodiments described above, but encompasses any and all embodiments within the scope of the following claims.

I claim:

1. A finger and palm guard for use by barbers and cosmeticians and covering the palmar fascia area in the region immediately adjacent the knuckles joining the metacarpals and the third phalanges of both the middle and index fingers, comprising:

a first finger protection ring including a protruding first palmar fascia shield;

a second finger protection ring including a protruding second palmar fascia shield, said first and second palmar fascia shields being parallel to one another and one of said shields partially overlying the other; and engagement means for movably engaging said first and said second palmar fascia shields, said engagement means located on an overlapping region of said first and second palmar fascia shields; whereby said first and second protection rings may be placed over the third phalanges of the index and middle fingers of the user's hand, said first and second palmar fascia shields covering and protecting the flexure and palm area adjacent the fingers, and the movable engagement means allowing for the two fingers thus protected to be moved toward and away from one another, in substantially unrestricted fashion.

2. The finger and palm guard according to claim 1, wherein said first and second protection rings are substantially identical.

3. The finger and palm guard according to claim 1 wherein said guard is made of plastics material.

4. The finger and palm guard according to claim 1, wherein each of said first and second protection rings further comprises flexure means adjoining said ring and palmar fascia shields together, such that the skin surface of the palmar fascia area behind and beneath said flexure means is protected while said finger rings and palmar fascia shields may be folded toward and away from one another in substantially unrestricted fashion, under urging of the natural hand movements of a user.

5. The finger and palm guard according to claim 1, wherein said engagement means for movably engaging said first and said second palmar fascia shields comprise a rivet having two halves relatively pivotal with respect from one another.

6. The finger and palm guard according to claim 5, wherein said rivet halves are dimensioned and configured so as to be readily separable from one another.

7. The finger and palm guard according to claim 5, wherein said rivet halves are dimensioned and configured so as to be permanently attached to one another.

8. A finger and palm guard for covering the palmar region of a user's hand comprising:

a forefinger protection ring including a first palmar shield;

a middle finger protection ring including a second palmar shield, said first palmar shield overlapping said second palmar shield; and a pivoting element for pivotally connecting said first palmar shield and said second palmar shield, said pivoting element located proximal an overlapping region of said first and second palmar shields.

9. The finger and palm guard according to claim 8, wherein said pivoting element further comprises a separable pivoting element configured so said first palmar shield is separable from said second palmar shield.

10. The finger and palm guard according to claim 9, wherein said separable pivoting element includes a rivet.

11. The finger and palm guard according to claim 8, wherein said first palmar shield is permanently connected to said second palmar shield by said pivoting element.

12. The finger and palm guard according to claim 11, wherein said pivoting element includes a rivet.

* * * * *